US010845031B2

(12) United States Patent
Maas

(10) Patent No.: US 10,845,031 B2
(45) **Date of Patent: *Nov. 24, 2020**

(54) COLLAPSIBLE SUSPENDED LIGHTING SYSTEM

(71) Applicant: NBCUniversal Media, LLC, New York, NY (US)

(72) Inventor: Richard William Maas, Simi Valley, CA (US)

(73) Assignee: NBCUniversal Media, LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/295,890

(22) Filed: Mar. 7, 2019

(65) Prior Publication Data

US 2019/0309926 A1 Oct. 10, 2019

Related U.S. Application Data

(63) Continuation of application No. 13/798,608, filed on Mar. 13, 2013, now Pat. No. 10,234,104.

(51) Int. Cl.

| | |
|---|---|
| ***F21V 11/02*** | (2006.01) |
| ***F21S 4/28*** | (2016.01) |
| ***F21S 2/00*** | (2016.01) |
| ***E06B 9/386*** | (2006.01) |
| ***E06B 9/24*** | (2006.01) |
| ***F21Y 103/00*** | (2016.01) |
| ***F21Y 115/10*** | (2016.01) |

(52) U.S. Cl.
CPC ..... *F21V 11/02* (2013.01); *F21S 2/00* (2013.01); *F21S 4/28* (2016.01); *E06B 9/386* (2013.01); *E06B 2009/247* (2013.01); *F21Y 2103/00* (2013.01); *F21Y 2115/10* (2016.08)

(58) Field of Classification Search
CPC ... E06B 2009/247; F21V 17/007; F21V 11/02
See application file for complete search history.

(56) References Cited

U.S. PATENT DOCUMENTS 6,042,243 A * 3/2000 Grill ..... G09F 13/0413 362/125
6,488,391 B1 * 12/2002 Gary ..... B44C 3/12 248/150

(Continued)

*Primary Examiner* — Alexander K Garlen
*Assistant Examiner* — Colin J Cattanach
(74) *Attorney, Agent, or Firm* — Fletcher Yoder, P.C.

(57) ABSTRACT

A lighting system comprises a flexible support, such as a pair of fabric or web-like strips, and a plurality of tubular light sources supported by the flexible support. The flexible support may be hung from a support structure, and the tubular light sources will hang generally parallel to one another. Each tubular light source may include a plurality of LED chips, and power supply or conversion circuitry may also be disposed in the tubular light sources. Power cabling extends to the light sources, and may be adapted to provide pass-through power to other, similar assemblies to form a modular system. The assemblies may be easily deployed and repacked for storage and movement. The system is suitable for large area lighting, particularly with panels used for theater, television, and film sets, or with displays, trade show installations, and so forth.

20 Claims, 5 Drawing Sheets

(56) References Cited

U.S. PATENT DOCUMENTS

| | | | | |
|---|---|---|---|---|
| 7,818,906 | B2 * | 10/2010 | Hansen | G09F 13/04 40/541 |
| 8,172,426 | B2 * | 5/2012 | Frey | G02F 1/133305 362/217.16 |
| 2008/0041533 | A1 * | 2/2008 | Ziegler | E06B 9/386 160/10 |
| 2008/0198584 | A1 * | 8/2008 | Fouraux | E04F 13/145 362/147 |
| 2010/0302772 | A1 * | 12/2010 | Lin | E06B 9/304 362/231 |
| 2011/0096531 | A1 * | 4/2011 | Frey | G02F 1/133305 362/97.4 |
| 2012/0299470 | A1 * | 11/2012 | Kobayashi | E06B 9/386 313/504 |
| 2013/0182440 | A1 * | 7/2013 | Ferrie | F21V 21/005 362/249.08 |
| 2015/0226391 | A1 * | 8/2015 | Sellam | F21V 19/003 362/249.02 |

* cited by examiner

COLLAPSIBLE SUSPENDED LIGHTING SYSTEM

CROSS REFERENCE TO RELATED APPLICATIONS

This application is a continuation of U.S. patent application Ser. No. 13/798,608, entitled "Collapsible Suspended Lighting System", filed Mar. 13, 2013.

BACKGROUND

The present invention relates to a routing system of the type used for both primitive and temporary displays, sets, installations, and so forth wherein a light source is placed behind a panel or other transparent or translucent medium.

In the field of lighting systems, particularly those used for theater, television, film, and other sets, trade shows, building and outdoor displays, and the like, certain known and reliable systems have been used for many years. For example, a backdrop is commonly used, which may comprise a rigid or flexible panel on which graphics or pictures are printed. Such panels may be hung behind a scene or set. In other applications, such as tradeshows, posters and panels may be hung or mounted in various locations in a display structure or installation. In theater, television, and film lighting, lights and systems that are sometimes referred to as "sky pans", "cyclorama or cyc lights" or floodlights may be disposed behind the panel, and powered to illuminate all or a portion of the panel. In many applications the panel is transparent or translucent to allow the graphics or image to be brightly illuminated by the backlighting. Such lighting is generally quite effective, but has definite drawbacks. For example, sky pan lights may need to be placed as much as 10 to 12 feet behind the panel. Moreover, depending upon the size of the light and the area illuminated, power ratings may range to approximately 4 kA or higher. The resulting lighting is thus hot, energy intensive, and space-consuming.

Moreover, such lighting systems are somewhat difficult to handle and tedious to displace and store after use or between uses. Where periodic changes are made to scenes or backdrops, or where the entire application may need to be moved to another location, current lighting systems must be carefully packed, along with supporting cords and structures, moved to a storage or new location, and carefully unpacked and set up. The systems tend to be large and heavy, making all of these operations more difficult.

There is a need, in this field, for improvements in lighting systems and methods that may at least partially address the drawbacks of current technologies.

BRIEF DESCRIPTION

The present disclosure sets out a new form or lighting system designed to respond to such needs. The system may include a flexible support configured to be suspended from a support structure, a plurality of tubular light sources held generally horizontally and parallel to one another by the flexible support, and electrical cabling coupled to the plurality of light sources to provide power to the light sources during operation.

In accordance with other aspects, the system may include a plurality of tubular light sources arranged in a ladder-like arrangement and held generally horizontally and parallel to one another by a flexible support that is configured to be suspended from a support structure during use, and collapsed for storage or movement. Electrical cabling is coupled to the plurality of light sources to provide power to the light sources during operation, the cabling comprising a first connector adjacent to a first point of the lighting system and configured to receive incoming power for the tubular light sources, and a second connector adjacent to a second point of the lighting system and configured to allow power to be passed along to another lighting system.

In accordance with still further aspects, the lighting system may comprise a plurality of modular lighting assemblies. Each modular lighting assembly comprises a plurality of tubular light sources arranged in a ladder-like arrangement and held generally horizontally and parallel to one another by a flexible support that is configured to be suspended from a support structure during use, and collapsed for storage or movement. Electrical cabling is coupled to the plurality of light sources to provide power to the light sources during operation. The cabling comprises a first connector adjacent to a first point of the lighting system and configured to receive incoming power for the tubular light sources from a power source or from another of the modular lighting assemblies, and a second connector adjacent to a second point of the lighting system and configured to allow power to be passed along to another of the modular lighting assemblies.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
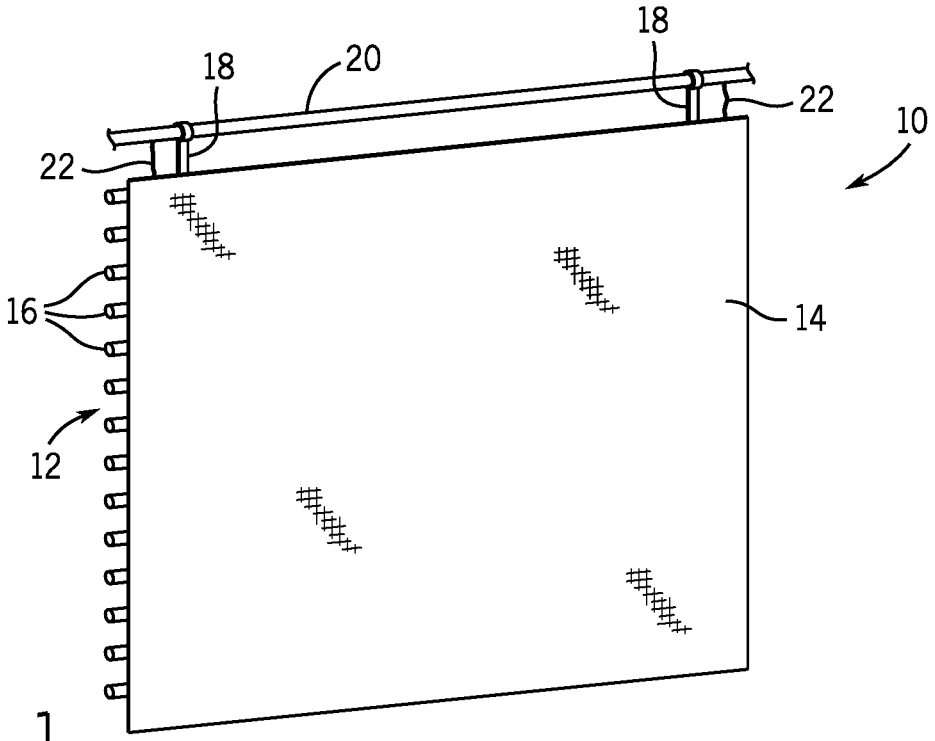
FIG. 1 is an illustration of exemplary set or display lit in accordance with aspects of the present techniques.

Turning now to the drawings, FIG. 1 illustrates a lighting system 10 that may be suitable for applications such as television and theater sets, film sets, tradeshows, and any one of the range of permanent, semi-permanent and temporary settings. In the illustrated embodiment a light assembly 12 is disposed behind a panel 14. The panel may be transparent or translucent, and may have components, graphics, scenes, or any desired feature drawn, applied, printed, painted or otherwise disposed on one or both sides thereof. The panel may also be colored or formed so as to provide any desired effect when light traverses or falls on the panel from the light assembly 12. The light assembly itself includes a series of parallel light tubes 16, in this case arranged horizontally behind the panel. As discussed in more detail below, each of the light tubes may comprise a series of light emitting diodes that create and project light towards the panel when powered. The light source or sources within the tubes may be powered by one or more circuits (e.g., transformers, drive circuits, power converters, etc.) either within the tubes or external to the tubes. The light tubes are supported on a flexible support structure indicated generally by reference numeral 18. In the embodiment illustrated in FIG. 1, two flexible supports extend upwardly from the light assembly and may be secured to a mechanical support 20, such as a bar over which the flexible support structures pass. Also visible in FIG. 1 is one or more power cables or harnesses 22 that allow for application of power to the light tubes.

Figure 2:
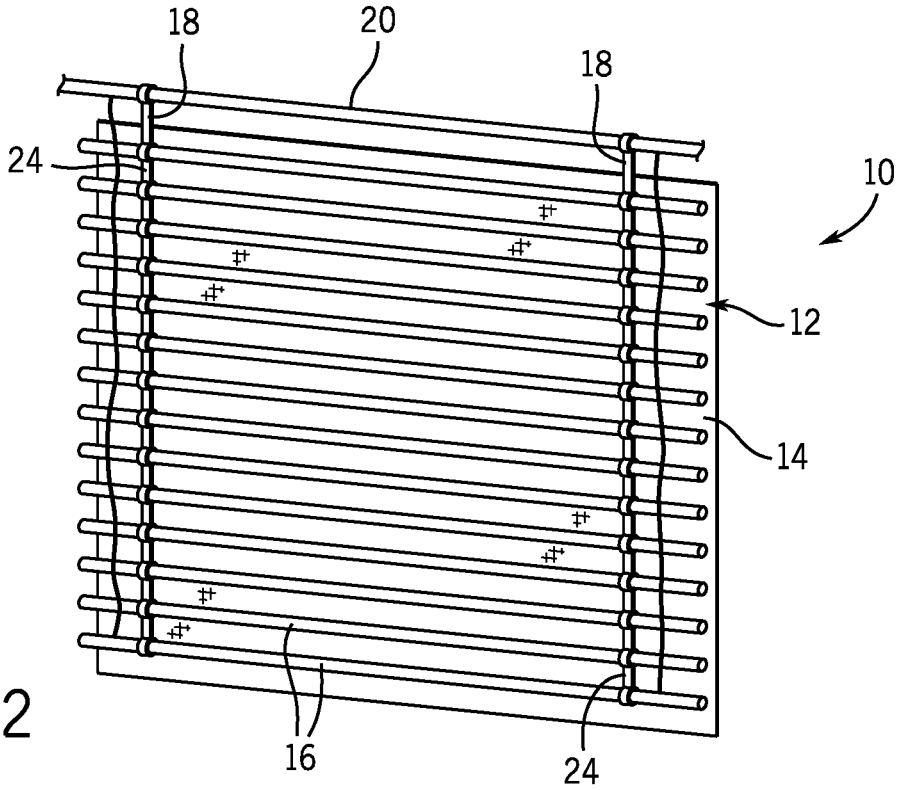
FIG. 2 is a diagram of the same display from a rear side.

The same structure is illustrated in FIG. 2 from a rear side. As noted above, the light assembly 12 comprises a series of light tubes 16 supported in a parallel arrangement by a flexible support structure 18. The panel 14 is placed adjacent to the light assembly and light from the assembly shines onto the panel as described more fully below. In the illustrated embodiment the flexible support structure comprises flexible vertical components that receive and support light tubes. These elements may be made of fabric, webbing, or any suitable flexible (i.e., collapsible) material, or a series of segments that can be easily hung and collapsed. Moreover, these elements of the support structure may include pockets that receive and support the light tubes, parallel webs with bridge-type members that are disposed under the light tubes, slots through which the light tubes pass, or any other suitable support. Effectively, then, the light assembly 12 is a hanging structure that is held by the bar 20 or any suitable upper mechanical support, with the light tubes being positioned in the flexible support structure 18 and held in place, in the generally parallel arrangement by gravity. One or more weights or other lower supports could also be used to maintain the system taut or stable once deployed. Accordingly, the entire arrangement is fully flexible, collapsible, easily packaged, and so forth as discussed below. In the currently contemplated embodiment, the power cables or harnesses provide power to the light tubes and may terminate in one or more corners of the light assembly with a male and/or female connector. For example, in a currently contemplated embodiment, at a lower corner of the light assembly a male electrical plug is provided that can be plugged into a grid outlet or extension cord (or other power source). Moreover, a female receptacle may be provided at a corner of the light assembly and coupled to the power cable so that power may be passed to one or more other light assemblies in a pass-through manner as discussed below.

Figure 3:
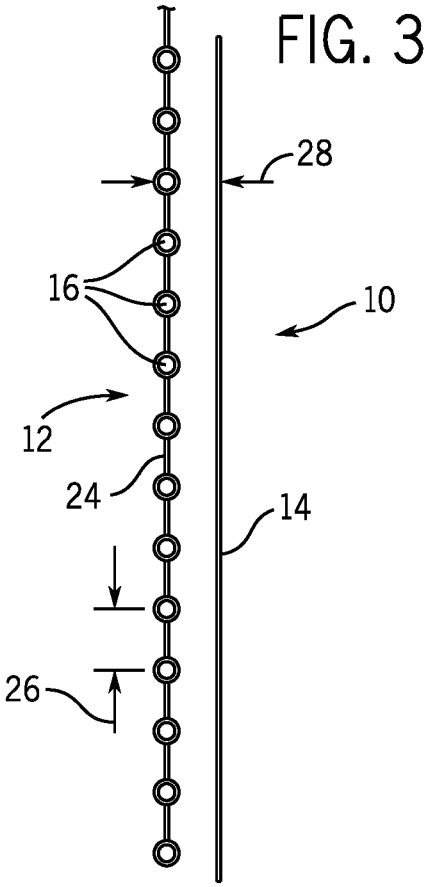
FIG. 3 is a side view of the display illustrating a front panel and a rear light assembly in accordance with aspects of the present techniques.

FIG. 3 is a side view of the light assembly and panel of the previous figures. The light system 10 here again includes the light assembly 12 disposed adjacent to the lit panel 14. In general, as discussed above, the light assembly will be placed in back of the panel 14, although in some embodiments similar light assemblies may be placed in front of, between, on top of or below similar panels, or in various curved configurations with respect to the panels. As mentioned above, the light assembly may form a module that may be used singly or with other similar modular light assemblies. In this modular approach, while the light assemblies may be different, they are conveniently identical, having the same number of light tubes and dimensions. In the illustrated embodiment, for example, 14 parallel light tubes are provided at equal spacings as indicated by reference numeral 26 in FIG. 3. Typical spacings may be, for example, between 6 inches and 12 inches. Unlike conventional high powered spotlights, moreover, the light assembly may be placed relatively close to the panel as indicated by dimension 28 in FIG. 3. By way of example, in currently contemplated embodiments, the light assembly is placed between 6 inches and 24 inches from the panel (rather than distances on the order of 4 to 8 feet for conventional lighting systems).

Figure 4:
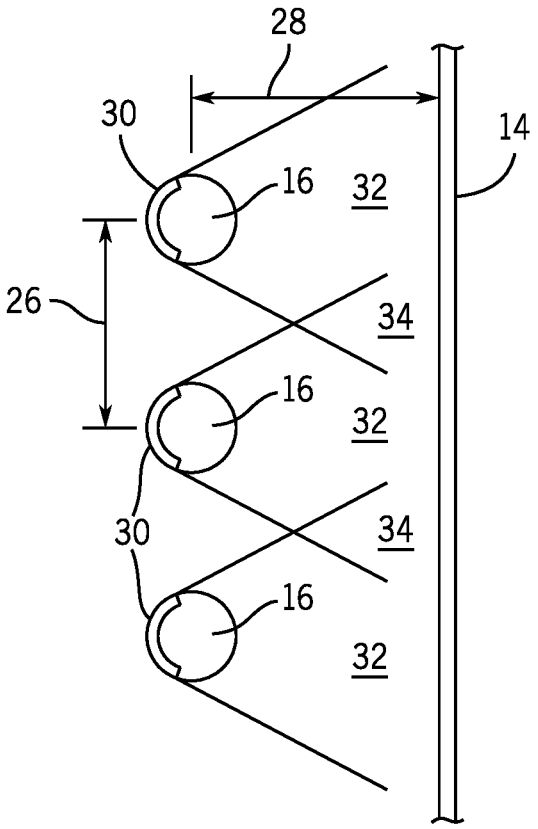
FIG. 4 is a diagrammatical representation of a series light tubes used in the system, illustrating exemplary physical configurations and arrangements for lighting a panel.

FIG. 4 is a detailed illustration of exemplary spacing and illumination by the light tubes. As noted above, while any suitable light tube may be employed, in currently contemplated embodiments each light tube comprises a cluster of light emitting diode (LED) chips (not separately shown) with a backing 30. The LED chips are configures so that light is effectively directed toward a forward face of the light tube. In the light tubes used in current embodiments, one or more electrical circuits are provided for converting AC power fed to the power cable to DC power for the individual light chips. These light chips may be designed to be powered, for example by 12 or 24 vDC, although any suitable power rating may be employed. Suitable light tubes may be obtained, for example, from Mac Tech LED under the designation TL6036WW. Moreover, the light tubes used in present embodiments have a luminous flux rating of approximately 3200 k lumen and a beam angle of approximately 120 degrees.

As shown in FIG. 4, the spacing 26 between the light tubes, along with the spacing 28 between the light assembly and the panel 14 preferably allow for some degree of overlap between the illuminated regions 32 of each light tube. That is, to provide even and consistent lighting of the panel, each light tube emits a region of illumination 32 that overlaps in adjacent area 34 as they approach the panel. In presently contemplated embodiments the overlap may comprise the full or nearly full combination of two adjacent light tubes, or more than two light tubes may contribute to overlapping regions.

Figure 5:
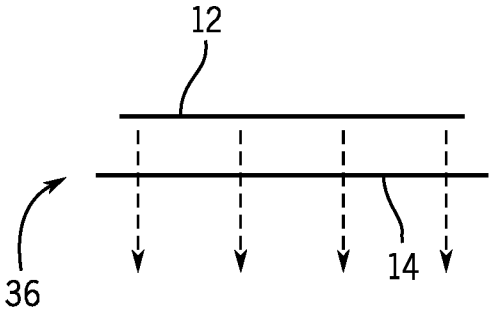
FIGS. 5-11 are diagrammatical representations of different modular configurations in which the light assemblies may be used.
Figure 6:
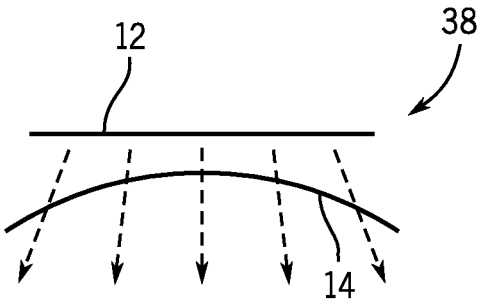
Figure 7:
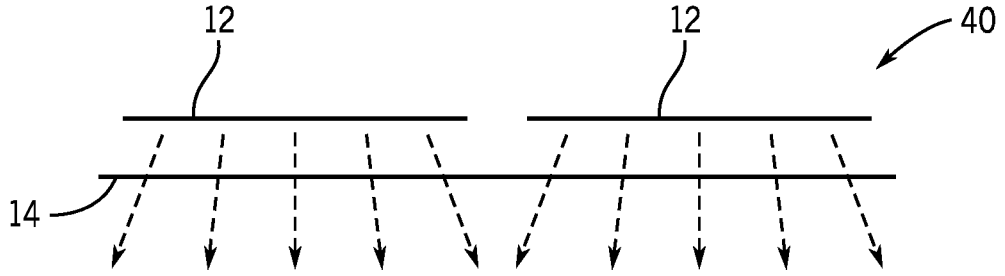
Figure 8:
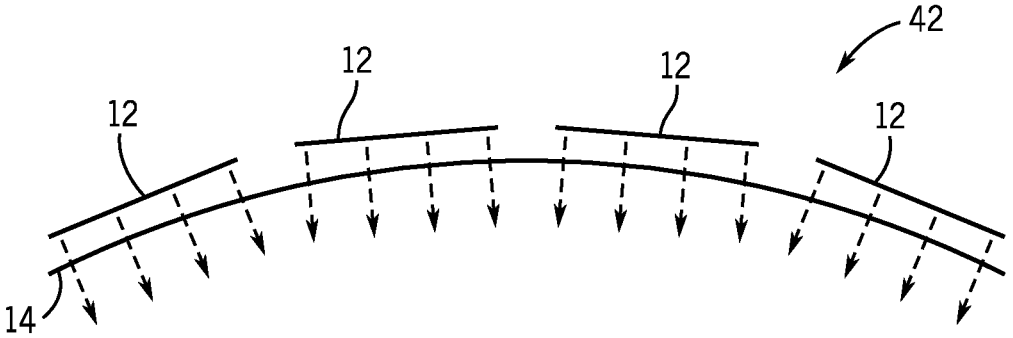

FIGS. 5-11 illustrate diagrammatically a series of embodiments in which the lighting system is used in a modular fashion with different arrangements of panels, typically for different settings and sizes. FIG. 5, for example, shows a single modular arrangement with a flat panel. This simple arrangement, designated by reference numeral 36, corresponds to the embodiments of FIGS. 1 and 2. In FIG. 6, a curved arrangement 38 includes a panel 14 that is arched or curved with respect to the light assembly. This curve could be convex with respect to the light assembly as shown in FIG. 6 or concave, or the panel could be arranged in a wavy fashion. FIG. 7 illustrates a modular arrangement 40 in which two light assemblies 12 are used to light a single panel 14. As noted above, in such arrangements, the light assemblies may be identical to one another in size, configuration, and lighting capacity, or could be different. FIG. 8 is shows a similar but larger arrangement 42 in which a series of four light assemblies are used to light a large curved panel.

Figure 9:
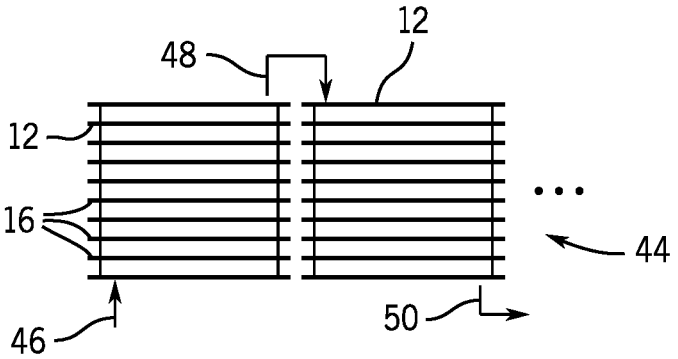
Figure 10:
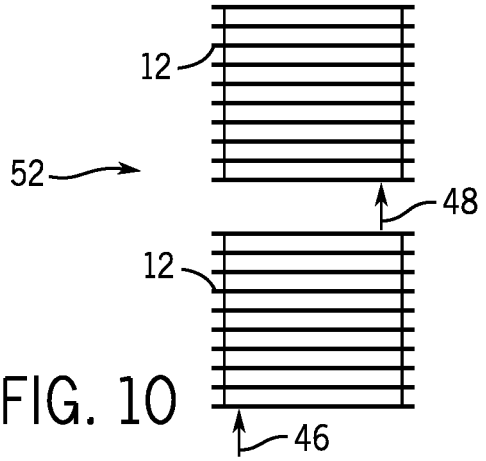
Figure 11:
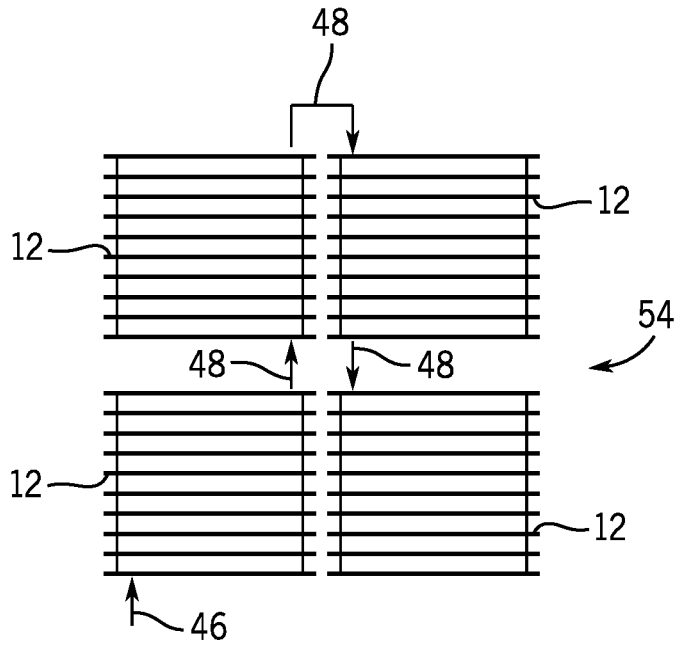

FIGS. 9, 10 and 11 show various ways in which modular panels may be interconnected to facilitate installation and powering. In FIG. 9, a side-by-side arrangement 44 comprises two identical light assemblies 12. Powers supplied at a lower corner of a first light assembly as indicated by reference numeral 46 (e.g., via a male plug as discussed above) and at an upper corner of the same panel power is transmitted to an adjacent panel as indicated by reference numeral 48. This may be accomplished, for example, by a female connector at the top of the first panel that joins a male connector at the top of the second. In this same arrangement, a lower connector may be provided for passing power through a subsequent panel, as indicated by reference numeral 50. It should be noted, however, that the placement and type of electrical connections may be varied, and these may be provided along the top, bottom, mid-points, or at any suitable location in the light assembly.

FIG. 10 illustrates a similar arrangement in which two panels 12 are provided in upper and lower positions. Here again, power is received in a first panel as indicated at reference numeral 46, and is passed to a second panel by an interconnection 48. In FIG. 11 a matrix or array of light assemblies is provided, with incoming and interconnecting power as discussed above. It should be noted that in upper and lower, and matrix-type arrangements, the support structures of the light tubes may be such that one entire light assembly may be simply hung onto an upper light assembly without additional mechanical supports being required.

Figure 12:
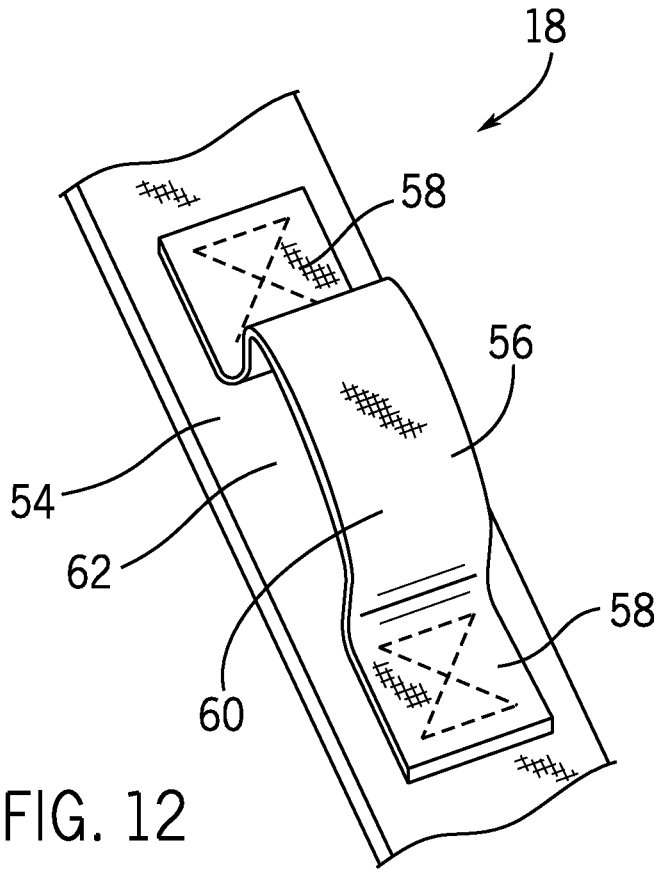
FIGS. 12 and 13 are detailed views of an exemplary arrangement for holding and orienting light tubes in a collapsible assembly.
Figure 13:
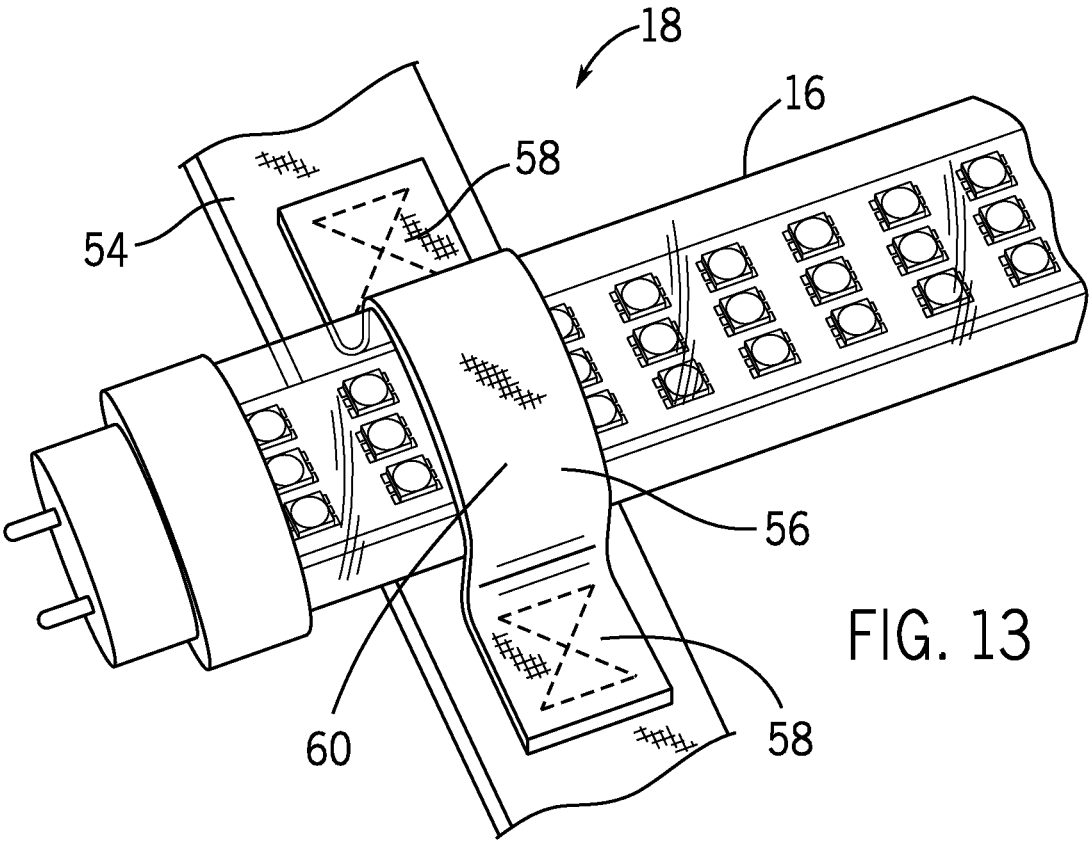

In presently contemplated configurations, the light tube support structure 18 is made of webbing material with loops to receive and secure the light tubes as generally illustrated in FIGS. 12 and 13. As shown in FIG. 12, a length of webbing 54 has loops 56 secured to a face, such as via stitching 58. The webbing may be made of any suitable material, such as a durable fabric. The loops 56 may be made of the same or another material, but in a present embodiment, they are made of an elastic fabric. A loop portion 60 forms an opening 62 through which the light tubes may be inserted, as shown in FIG. 13. The resulting structure will not only hold the light tubes in place, but will provide a secure orientation of the tubes so that the light sources within each tube will remain properly directed as described above. It has been found that tension on the webbing and loops as the system is raised into position aids at securely holding and orienting the light tubes.

Figure 14:
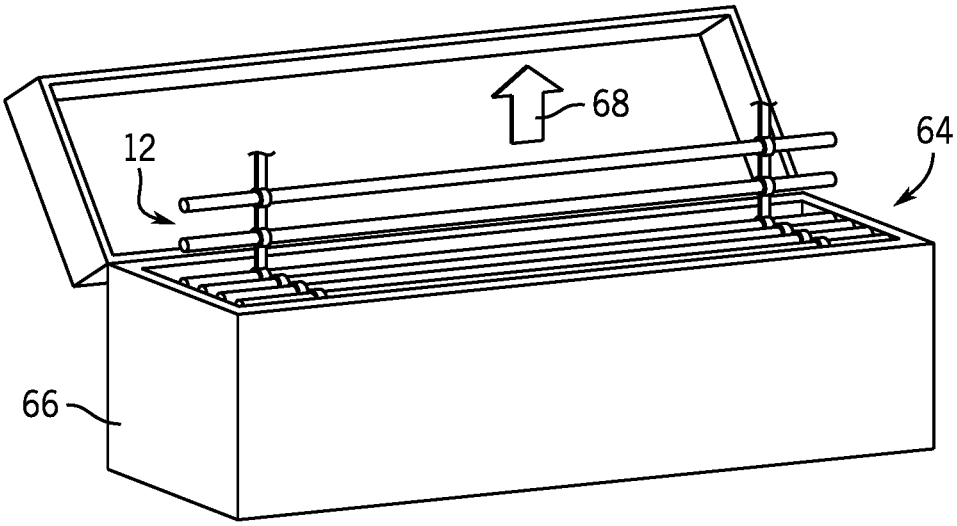
FIG. 14 is an illustration of a straightforward manner in which the lighting system may be packed and unpacked for storage and relocation.

As noted above, the lighting system allows for easily collapsing the entire flexible structure for disassembly, storage and transport. As illustrated in FIG. 14, for example, one or more of the light assemblies may be positioned in a collapsed arrangement 64 within a storage or transport crate or trunk 66. The entire assembly will then be self-contained, and could be extracted, mounted and used following very straightforward removal as indicated by arrow 68 in FIG. 14. In presently contemplated embodiments, all circuitry and power cabling is pre-assembled in the light assembly, as discussed above, so that take-down and set-up are greatly facilitated. Moreover, importantly, rather than the complex special shipping arrangements required for transport of conventional lighting systems, the collapsible structure described allows for much smaller and simple packaging that can be transported more compactly and via commercial carriers.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A lighting system, comprising:

a lighting apparatus, comprising:

a plurality of light sources; and a first support configured to be attached to a second support, the first support comprising a first member and a second member, wherein the first and second members are spatially offset from one another along an axis extending laterally along a length of the plurality of light sources, and wherein:

the first member consists of:

first and second ends that are end-most portions of the first member that terminate the first member, wherein the first end terminates at the second support and the second end is indirectly supported by the second support without any additional direct support other than the first member; and first intermediate portions, wherein:

the first intermediate portions of the first member are configured to support a first portion of each of the plurality of light sources by acting in conjunction with the first member to fully encompass the first portion, wherein the first intermediate portions in conjunction with the first member are configured to form a first opening through which the first portion is inserted, and the first end is configured to be directly supported by the second support and the second end is indirectly supported by the second support and is detached from any support, when fully deployed;

the second member consists of:

third and fourth ends that are end-most portions of the second member that terminate the second member, wherein the third end terminates at the second support and the fourth end is indirectly supported by the second support without any additional direct support other than the second member; and second intermediate portions, wherein:

the second intermediate portions of the second member are configured to support a second portion of each of the plurality of light sources by acting in conjunction with the second member to fully encompass the second portion, wherein the second intermediate portions in conjunction with the second member are configured to form a second opening through which the second portion is inserted, and the third end is configured to be directly supported by the second support and the fourth end is indirectly supported by the second support and is detached from any support, when fully deployed.

2. The lighting system of claim 1, wherein the lighting apparatus is configured to selectively transition to a fully collapsed state via bending of the first support.

3. The lighting system of claim 2, wherein the lighting apparatus is configured to selectively transition to a fully-deployed state from the fully collapsed state by pulling an upper portion of the lighting apparatus upward and attaching the first end and the third end to the second support without assembly of additional supports.

4. The lighting system of claim 3, comprising a storage crate, wherein the storage crate is configured to store the lighting system in the fully collapsed state.

5. The lighting system of claim 1, wherein the first intermediate portions and the second intermediate portions are configured to generate tension as the lighting apparatus is transitioned to a fully-deployed state, wherein the tension is configured to securely hold and orient the plurality of light sources.

6. The lighting system of claim 1, wherein the first intermediate portions and the second intermediate portions comprise a fabric or webbing.

7. The lighting system of claim 1, wherein the first intermediate portions and the second intermediate portions comprise pockets or slots.

8. The lighting system of claim 1, wherein the second end and the fourth end is attached to one or more weights to maintain a tautness to the first member and the second member when the lighting apparatus is in a fully-deployed state.

9. A lighting system, comprising:

a first lighting apparatus and a second lighting apparatus, wherein the first lighting apparatus and the second lighting apparatus are configured, together, to provide lighting for a common lighting panel, wherein the first lighting apparatus and the second lighting apparatus each respectively comprises:

a plurality of light sources; and a first support configured to be attached to a second support, the first support comprising a first member and a second member, wherein the first and second members are spatially offset from one another along an axis extending laterally along a length of the plurality of light sources, and wherein:

the first member consists of:

first and second ends that are end-most portions of the first member that terminate the first member, wherein the first end terminates at the second support and the second end is indirectly supported by the second support without any additional direct support other than the first member; and first intermediate portions, wherein:

the first intermediate portions of the first member are configured to support a first portion of each of the plurality of light sources by acting in conjunction with the first member to fully encompass the first portion, wherein the first intermediate portions in conjunction with the first member are configured to form a first opening through which the first portion is inserted, and the first end is configured to be directly supported by the second support and the second end is indirectly supported by the second support and is detached from any support, when fully deployed;

the second member consists of:

third and fourth ends that are end-most portions of the second member that terminate the second member, wherein the third end terminates at the second support and the fourth end is indirectly supported by the second support without any additional direct support other than the second member; and second intermediate portions, wherein:

the second intermediate portions of the second member are configured to support a second portion of each of the plurality of light sources by acting in conjunction with the second member to fully encompass the second portion, wherein the second intermediate portions in conjunction with the second member are configured to form a second opening through which the second portion is inserted, and the third end is configured to be directly supported by the second support and the fourth end is indirectly supported by the second support and is detached from any support, when fully deployed.

10. The lighting system of claim 9, wherein the first lighting apparatus and the second lighting apparatus are electrically coupled to one another.

11. The lighting system of claim 9, wherein the first lighting apparatus and the second lighting apparatus are configured in a side-by-side configuration, wherein the first lighting apparatus is disposed beside the second lighting apparatus.

12. The lighting system of claim 9, wherein the first lighting apparatus and the second lighting apparatus are configured in an upper and lower configuration, wherein the first lighting apparatus is disposed above the second lighting apparatus.

13. The lighting system of claim 12, wherein a portion of the first lighting apparatus directly supports the first end of the second lighting apparatus and the third end of the second lighting apparatus.

14. The lighting system of claim 9, comprising a third lighting apparatus with the same components as the first lighting apparatus and the second lighting apparatus.

15. The lighting system of claim 14, wherein the first lighting apparatus, the second lighting apparatus, and the third lighting apparatus are configured in a matrix configuration, wherein the first lighting apparatus is disposed above the second lighting apparatus and the third lighting apparatus is disposed beside the first lighting apparatus or the second lighting apparatus.

16. The lighting system of claim 15, wherein a portion of the first lighting apparatus directly supports the first end of the second lighting apparatus and the third end of the second lighting apparatus.

17. The lighting system of claim 9, wherein the common lighting panel spans a length of the first lighting apparatus and the second lighting apparatus.

18. The lighting system of claim 17, wherein the common lighting panel comprises a convex or concave lighting panel.

19. A method of using a lighting apparatus, wherein the lighting apparatus comprises:

a plurality of light sources; and a first support configured to be attached to a second support, the first support comprising a first member and a second member, wherein the first and second members are spatially offset from one another along an axis extending laterally along a length of the plurality of light sources, and wherein:

the first member consists of:

first and second ends that are end-most portions of the first member that terminate the first member, wherein the first end terminates at the second support and the second end is indirectly supported by the second support without any additional direct support other than the first member; and first intermediate portions, wherein:

the first intermediate portions of the first member are configured to support a first portion of each of the plurality of light sources by acting in conjunction with the first member to fully encompass the first portion, wherein the first intermediate portions in conjunction with the first member are configured to form a first opening through which the first portion is inserted, and the first end is configured to be directly supported by the second support and the second end is indirectly supported by the second support and is detached from any support, when fully deployed;

the second member consists of:

third and fourth ends that are end-most portions of the second member that terminate the second member, wherein the third end terminates at the second support and the fourth end is indirectly supported by the second support without any additional direct support other than the second member; and second intermediate portions, wherein:

the second intermediate portions of the second member are configured to support a second portion of each of the plurality of light sources by acting in conjunction with the second member to fully encompass the second portion, wherein the second intermediate portions in conjunction with the second member are configured to form a second opening through which the second portion is inserted, and the third end is configured to be directly supported by the second support and the fourth end is indirectly supported by the second support and is detached from any support, when fully deployed;

the method comprising:

fully deploying the lighting apparatus from a collapsed state, wherein fully deploying the lighting apparatus comprises:

extracting an upper portion of the lighting apparatus to generate tautness of the first member and the second member; and securing the first end and the second end to the second support.

20. The method of claim 19, comprising:

placing the lighting apparatus between 6 inches and 24 inches from a lighting panel; and illuminating the lighting panel via the lighting apparatus.

* * * * *